US011898417B2

(12) United States Patent
Wang et al.

(10) Patent No.: US 11,898,417 B2
(45) Date of Patent: Feb. 13, 2024

(54) DRILLING SPEED INCREASING DEVICE

(71) Applicants: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

(72) Inventors: Jiachang Wang, Beijing (CN); Haiping Zhang, Beijing (CN); Yanbin Zang, Beijing (CN); Mingguang Sun, Beijing (CN); Guangjun Ma, Beijing (CN); Lishuang Wang, Beijing (CN); Lingchao Xuan, Beijing (CN); Xiaodan Liu, Beijing (CN); Renlong Zhang, Beijing (CN)

(73) Assignees: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

( * ) Notice: Subject to any disclaimer, the term of this patent is extended or adjusted under 35 U.S.C. 154(b) by 0 days.

(21) Appl. No.: 17/757,205

(22) PCT Filed: Sep. 11, 2020

(86) PCT No.: PCT/CN2020/114861
§ 371 (c)(1),
(2) Date: Jun. 10, 2022

(87) PCT Pub. No.: WO2021/120723
PCT Pub. Date: Jun. 24, 2021

(65) Prior Publication Data

US 2023/0003085 A1 Jan. 5, 2023

(30) Foreign Application Priority Data

Dec. 16, 2019 (CN) ..... 201911294230.2

(51) Int. Cl.
*E21B 4/16* (2006.01)

(52) U.S. Cl.
CPC ..... *E21B 4/16* (2013.01)

(58) Field of Classification Search
CPC ... E21B 4/10; E21B 4/006; E21B 4/16; E21B 6/06; E21B 6/08
See application file for complete search history.

(56) References Cited

U.S. PATENT DOCUMENTS

2015/0107904 A1 4/2015 Kerstetter
2018/0283101 A1 10/2018 Von Gynz-Rekowski et al.

FOREIGN PATENT DOCUMENTS

CN 103321569 A 9/2013
CN 104033113 A 9/2014
(Continued)

*Primary Examiner* — Robert E Fuller
(74) *Attorney, Agent, or Firm* — NKL Law; Allen Xue

(57) ABSTRACT

A drilling speed-enhancing device has an outer cylinder a rotary main shaft arranged in an inner chamber of the outer cylinder and configured to rotate around its own axis; an output main shaft arranged below the rotary main shaft and configured to be driven by the rotary main shaft to rotate around its own axis, a lower end of the output main shaft extending out of the inner chamber of the outer cylinder for connecting with a drilling bit of a dual-drive drilling tool; and a percussion generator arranged between the output main shaft and the outer cylinder. The percussion generator can drive the outer cylinder and the rotary main shaft to move upward relative to the output main shaft, so that under action of WOB, the rotary main shaft and the outer cylinder move downward to generate impact on the output main shaft.

16 Claims, 3 Drawing Sheets

(56) References Cited

FOREIGN PATENT DOCUMENTS

| | | | | | |
|---|---|---|---|---|---|
| CN | 105275384 | A | | 1/2016 | |
| CN | 204941340 | U | * | 1/2016 | ..... E21B 4/16 |
| CN | 204941340 | U | | 1/2016 | |
| CN | 108915583 | A | | 11/2018 | |
| CN | 109098654 | A | | 12/2018 | |

* cited by examiner

DRILLING SPEED INCREASING DEVICE

CROSS REFERENCE OF RELATED APPLICATION

This application is a U.S. national stage entry of PCT International Application No. PCT/CN2020/114861, filed on Sep. 11, 2020, which claims the priority of Chinese patent application No. 201911294230.2, entitled "Drilling Speed Increasing Device," and filed on Dec. 16, 2019, the entire content of which is incorporated herein by reference.

TECHNICAL FIELD

The present invention relates to the technical field of oil and gas well drilling, in particular to a drilling speed-enhancing device.

TECHNICAL BACKGROUND

With the rapid development of the oil industry, people's demand for oil is ever growing. The exploration and exploitation of oil and gas resources are gradually developing toward deep formations, so that the drilling speed enhancement in deep/ultra-deep wells has always been a technical problem confronted in the developments of well drilling technology. Rotary percussion drilling technology uses various percussive tools to generate high-frequency impacting loads, which can result in volumetric fracture of rocks and thus improve the rock-breaking effect.

Research shows that with a combination of the dual-drive drilling technology and the rotary percussion drilling technology can achieve volumetric fracture of rocks under high-frequency impact and high-speed rotary cutting, so that the speed-enhancing effect will be more obvious.

SUMMARY OF THE INVENTION

In view of the above problem, the present invention proposes a drilling speed-enhancing device, which can be arranged on a dual-drive drilling tool to generate high-frequency impacting loads by the drilling bit, resulting in volumetric fracture of rocks to improved rock-breaking efficiency.

According to the present invention, a drilling speed-enhancing device is proposed, comprising: an outer cylinder; a rotary main shaft arranged in an inner chamber of the outer cylinder and configured to rotate around its own axis; an output main shaft arranged below the rotary main shaft and configured to be driven by the rotary main shaft to rotate around its own axis, a lower end of the output main shaft extending out of the inner chamber of the outer cylinder for connecting with a drilling bit of a dual-drive drilling tool; and a percussion generator arranged between the output main shaft and the outer cylinder, and configured to drive the outer cylinder and the rotary main shaft to move upward relative to the output main shaft, so that under action of WOB, the rotary main shaft and the outer cylinder move downward to generate impact on the output main shaft.

In one embodiment, the percussion generator comprises: an upper cam arranged around an outer wall of the output main shaft in a clearance fit, and fixed relative to the outer cylinder in an axial direction and a circumferential direction, a lower end of the upper cam being provided with driven teeth; and a lower cam arranged around the outer wall of the output main shaft, and provided at an upper end thereof with driving teeth, which form with the driven teeth a conjugate set of cam teeth. During rotation of the output main shaft the lower cam is driven to rotate, and the driving teeth act on the driven teeth to enable that the upper cam moves reciprocally in the axial direction and acts on the outer cylinder.

In one embodiment, a lower cam seat is fixedly arranged around the output main shaft, and an outer wall of the lower cam seat is provided with engaging teeth protruding therefrom, each clamping tooth extending radially outward in a respective one of engaging slots formed on a wall of the lower cam, an upper end face of the lower cam seat abutting against a first step surface formed in an inner chamber of the lower cam.

In one embodiment, a lower end face of the lower cam extends axially over a lower end face of the lower cam seat to abut against a damping assembly arranged around the output main shaft, a lower end face of the damping assembly being in contact with a limiting sleeve arranged on the output main shaft.

In one embodiment, the damping assembly comprises two retaining rings axially spaced from each other, and a disc spring arranged between said two retaining rings, an upper one of the retaining rings abutting against the lower end face of the lower cam while a lower one of the retaining rings abutting against the limiting sleeve.

In one embodiment, the outer cylinder is of a combined structure, and comprises an upper joint and a cylindrical body connected to a lower end of the upper joint via thread, an outer wall of the upper cam being sandwiched between a lower end face of the upper joint and a second step surface formed on the cylindrical body, and an upper end face of the upper cam being connected with the lower end face of the upper joint via teeth.

In one embodiment, an upper end of the output main shaft extends into an inner chamber of the rotary main shaft and forms a circumferential snap-fit connection therebetween. An upper end face of the output main shaft is opposite to a third step surface formed on an inner side of the rotary main shaft, wherein an axially extending limiting groove is arranged on an outer wall of the output main shaft, and a limiting key is fixed on the rotary main shaft to extend radially into the limiting groove.

In one embodiment, a wall of the rotary main shaft is provided with a step hole passing therethrough, the limiting key radially extending in the step hole to be clamped therewith. A ferrule radially abutting against the limiting key is fixed on the outer wall of the rotary main shaft.

In one embodiment, a tungsten carbide ("TC") bearing assembly is provided between the outer cylinder and the output main shaft. An inner ring of the TC bearing assembly is connected with the output main shaft in an interference fit, a bearing shell of the TC bearing assembly is fixedly arranged on the lower end of the outer cylinder, and an inner-ring locking nut of the TC bearing assembly is fixedly arranged around the output main shaft, and located above the inner ring of the TC bearing assembly.

In one embodiment, a first seal is provided between the outer cylinder and the rotary main shaft, and a second seal is provided between the inner ring and the bearing shell of the TC bearing assembly. Lubricating oil is filled in a spaced defined by the first seal, the second seal, the outer cylinder, the rotary main shaft and the output main shaft.

Compared with the prior arts, the present invention has the advantages as follows. The drilling speed-enhancing device can be arranged in a drilling tool, such as a dual-drive drilling tool. Under the action of the percussion generator, the output main shaft will be subjected to axial impact, which can be transmitted to the drilling bit arranged at the lower end of the a output main shaft, so that the drilling bit can generate impact on the formation. This compound action facilitates to break up the formation rapidly, thus increasing drilling efficiency and reducing drilling cost.

BRIEF DESCRIPTION OF THE DRAWINGS

In the following the present invention will be explained in more detail by way of embodiments with reference to the accompanying drawings. In the drawings.

In the drawings, the same reference numerals are used to indicate the same components. The drawings are not drawn to actual scale.

DETAILED DESCRIPTION OF EMBODIMENTS

The present invention will be further described below in conjunction with the accompanying drawings.

Figure 1:
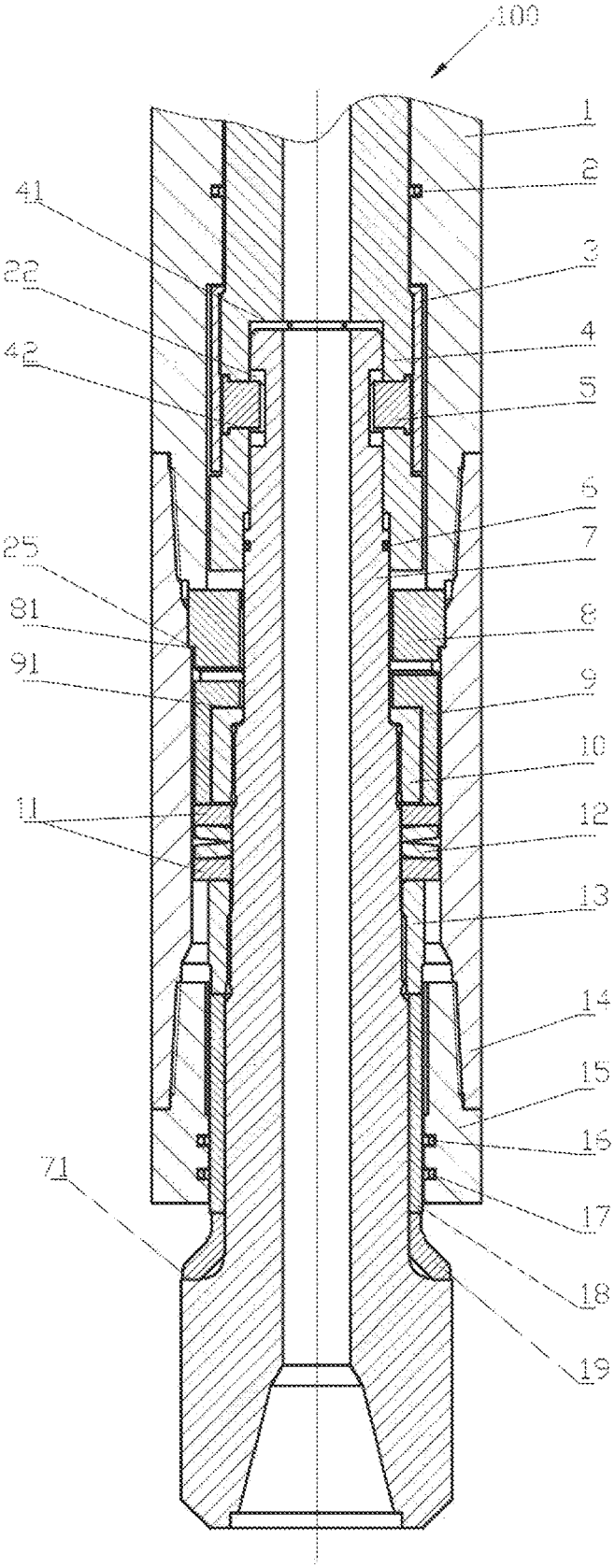
FIG. 1 schematically shows a drilling speed-enhancing device according to an embodiment of the present invention.

FIG. 1 schematically shows one embodiment of a drilling speed-enhancing device 100 according to the present invention. The drilling speed-enhancing device 100 can be applied to a dual-drive drilling tool to generate high-frequency impact for improving rock-breaking efficiency. Specifically, the drilling speed-enhancing device 100 includes an outer cylinder, a rotary main shaft 4, an output main shaft 7, and a percussion generator. The outer cylinder 1 is cylindrical and connected with a housing of a downhole power motor of the dual-drive drilling tool, mainly for connection and force transmission. The rotary main shaft 4 is arranged in an inner chamber of the outer cylinder 1, and connected with a rotating shaft of the downhole power motor of the dual-drive drilling tool to be driven to rotate around its own axis, for transmitting rotational power. The output main shaft 7 is arranged at a lower end of the rotary main shaft 4, and configured to rotate around its own axis when being driven by the rotary main shaft 4, for transmitting rotational power to a drilling bit arranged at a lower end of the output main shaft 7. The percussion generator is provided between the output main shaft 7 and the outer cylinder. The percussion generator can actuate the center of gravity (i.e., neutral point) of a combination consisting of the outer cylinder, the rotary main shaft 4, and the upper drilling string fixedly connected therewith (collectively referred to as driven assembly) to move upward relative to the output main shaft 7, that is, enable the neutral point of the whole drilling string to move upward. And under the action of the WOB, the center of gravity of the driven assembly (that is, the neutral point of the drilling string) moves down to impact on the output main shaft 7, so as to form an instantaneously high "percussive WOB", like "churn drilling", and further provide impact energy for the drilling bit. Therefore, the drilling speed-enhancing device 100 of the present invention can be applied to the dual-drive drilling tool to generate high-frequency reciprocating percussive WOB on the formation while driving the drilling bit to rotate in a high speed by the dual-drive power. This compound action facilitates to break up the formation rapidly, thus increasing drilling efficiency and reducing drilling cost.

Figure 5A:
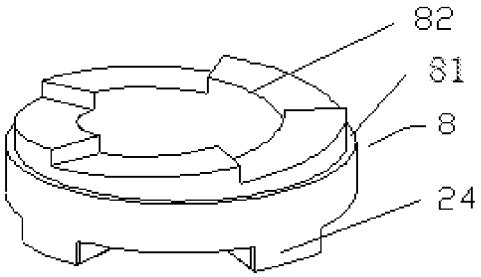
FIG. 5A shows a perspective view of an upper cam according to one embodiment in the drilling speed-enhancing device of FIG. 1.
Figure 5B:
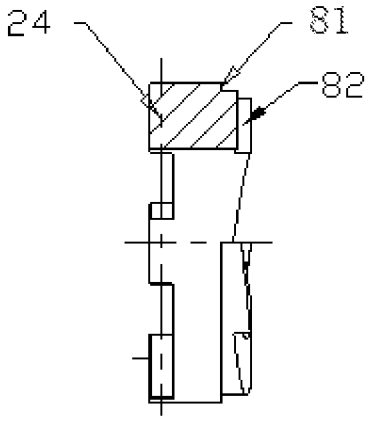
FIG. 5B shows a cross-sectional view of the upper cam according to one embodiment in the drilling speed-enhancing device of FIG. 1.
Figure 6A:
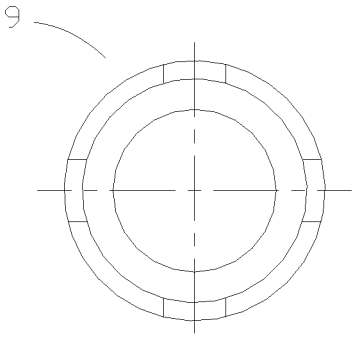
FIG. 6A shows a front view of a lower cam according to one embodiment in the drilling speed-enhancing device of FIG. 1.
Figure 6B:
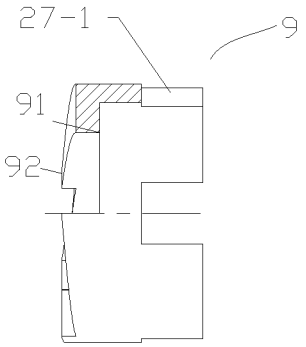
FIG. 6B shows a right view of the lower cam according to one embodiment in the drilling speed-enhancing device of FIG. 1.
Figure 7A:
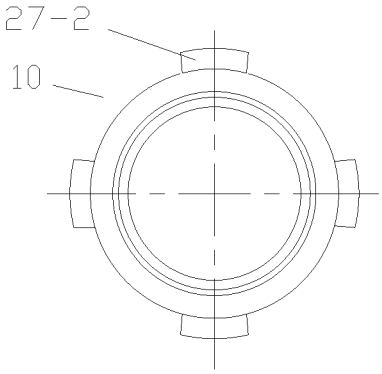
FIG. 7A shows a front view of a lower cam seat according to one embodiment in the drilling speed-enhancing device of FIG. 1.
Figure 7B:
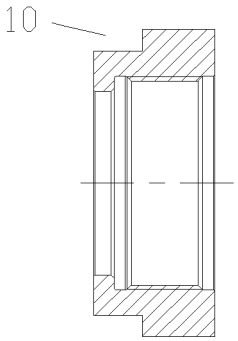
FIG. 7B shows a right view of the lower cam seat according to one embodiment in the drilling speed-enhancing device of FIG. 1.

In one embodiment, the percussion generator has an upper cam 8, a lower cam 9, and a lower cam seat 10. As shown in FIGS. 5A and 5B, the upper cam 8 per se is cylindrical, and arranged around an outer wall of the output main shaft 7 with a gap. The upper cam 8 is fixed relative to the outer cylinder in an axial direction and a circumferential direction. As shown in FIGS. 7A and 7B, the lower cam seat 10 per se is cylindrical, and fixedly arranged around the output main shaft 7. For example, the lower cam seat 10 is screwed on the output main shaft 7 by a left-handed trapezoidal thread. Moreover, on the threaded connection area between the lower cam seat 10 and the output main shaft 7, the lower cam seat 10 and the output main shaft 7 are engaged with each other through step surfaces, so that the output main shaft 7 can restrict the axial position of the lower cam seat 10. Further, as shown in FIGS. 6A and 6B, the lower cam 9 per se is cylindrical, and arranged around an outer wall of the lower cam seat 10. The outer wall of the lower cam seat 10 is provided with engaging teeth 27-2 radially protruding out. At the same time, the wall of the lower cam 9 is provided with engaging slots 27-1. Upon assembly, each of the engaging teeth 27-2 extends radially into a corresponding one of the engaging slots 27-1, thus forming a snap-fit connection between the lower cam 9 and the lower cam seat 10 in the circumferential direction. Therefore, the output main shaft 7 can drive the lower cam seat 10 into rotation through the engagement between step surfaces, while the rotation of the lower cam seat 10 can drive the lower cam 9 into rotation through the snap-fit connection. For example, a plurality (say, three, four, or five, etc.) of the engaging teeth 27-2 may be arranged at intervals in the circumferential direction, in order to achieve uniform transmission of torque. In addition, a first step surface 91 is arranged in an inner chamber of the lower cam 9 to abut against an upper end face of the lower cam seat 10, so that the downward axial movement of the lower cam 9 can be restricted by the lower cam seat 10. At the same time, during the movement of the upper cam 8 pushed by the lower cam 9, the lower cam 9 presses against the lower cam seat 10, so that the axial force received by the lower cam 9 will be transmitted downward through the lower cam seat 10 to the output main shaft 7, and finally to the drilling bit. The above structure adopts the lower cam 9 and the lower cam seat 10 that are separate from each other, so that the structure is simple, the processing is convenient, the installation and replacement are easy, and the use cost is reduced.

The outer cylinder consists of two parts, i.e., an upper joint 1 and a cylindrical body 14 disposed at a lower end of the upper joint 1. The upper joint 1 is directly connected with the housing of the downhole power motor of the dual-drive drilling tool. An upper end of the cylindrical body 14 is arranged around the outer wall of the upper joint 1, and connected therewith by means of inclined threaded surfaces. A second step surface 25 is arranged on an inner wall of the cylindrical body 14 in a manner of opposite to a lower end face of the upper joint 1 extending into the inner chamber of the cylindrical body 14. The outer wall of the upper cam 8 at the lower end thereof is provided with a fourth step surface 81, so that the upper cam 8 radially extends to be partially sandwiched between the lower end face of the upper joint 1 and the second step surface 25. Accordingly, the second step surface 25 and the fourth step surface 81 together forms an axial locking structure. With the above arrangement, the axial position of the upper cam 8 can be restricted by the outer cylinder. Moreover, the upper end face of the upper cam 8 and the lower end face of the upper joint 1 are engaged with each other through teeth. Specifically, multiple sector-shaped teeth 24 circumferentially spaced from each other extend from the upper end face of the upper cam 8, and multiple sector-shaped slots (not shown) circumferentially spaced from each other are formed in the lower end face of the upper joint 1. Each tooth 24 can be inserted into a corresponding one of the sector-shaped slots to form a snap-fit connection. With the above arrangement, the rotation of the upper cam 8 can be restricted by the upper joint 1. In the above arrangement, the upper cam 8 makes full use of its axial engagement with the upper joint 1 and the cylinder body 14 to provide a compact structure, so that the axial length of the drilling speed-enhancing device 100 is shortened, and the upper cam 8 can be restricted in the axial direction and also prevented from dropping-off.

Driven teeth 82 are arranged on the lower end of the upper cam 8, and each have a tooth surface substantially facing downward. Correspondingly, driving teeth 92 are arranged on the upper end of the lower cam 9, and each has a tooth surface substantially facing upward. Upon assembly, the driven teeth 82 and the driving teeth 92 are opposite and engaged with each other to form a conjugate set of cam teeth. Each of the driven teeth 82 and the driving teeth 92 may be generally configured as a wave-like shape as shown in FIGS. 5A and 6B. In operation, the lower cam 9 starts to rotate clockwise when being driven by the output main shaft 7. A pushing-up stroke will start when troughs of the driven teeth 82 face toward peaks of the driving teeth 92. Since the upper cam 8 is axially sandwiched between the upper joint 1 and the cylinder body 14 and also circumferentially locked with the upper joint 1, the upper cam 8 can actuate the center of gravity of a combination consisting of the outer cylinder, the rotary main shaft 4, and the upper drilling string fixedly connected therewith and located below the neutral point (collectively referred to as driven assembly) to move upward relative to the lower cam 9. When the peaks of the driven teeth 82 face toward the peaks of the driving teeth 92 while the troughs of the driven teeth 82 face toward to the troughs of the driving teeth 92, the center of gravity of the combination consisting of the upper cam 82, the outer cylinder, the rotary main shaft 4, and the upper drilling string fixedly connected therewith and located below the neutral point (collectively referred to as driven assembly) reaches its highest point. At this time, the axial distance between the peaks of the upper cam 8 and the troughs of the lower cam 9 is D, and that between the upper end face of the output main shaft 7 and the third step surface 41 (described in detail later) of the rotary main shaft 4 is C, wherein D>C. After that, the center of gravity of the driven assembly (that is, the neutral point of the drilling string) suddenly moves downward, that is, the driven assembly impacts downward under the action of the WOB. Since D>C, the impact acts on the upper end face of the output main shaft 7, so that impact energy will be transmitted to the downstream drilling bit through the output main shaft 7, thus forming an instantaneously high "percussive WOB", like "churn drilling", and further providing the impact energy for the drilling bit. In this manner, the drilling bit can impact downward on the formation during rotating-while-drilling. Subsequently, a new stage of engaging-rotating-pushing begins between the teeth of the upper cam 8 and the lower cam 9, and the WOB returns to its normal value. That is, the neutral point of the drilling string returns to its original position, so that a next stage of lifting stroke begins. In this manner, a periodic change of the WOB is repeated in cycle.

In a preferred embodiment, each of the wave-like driven teeth 82 and driving teeth 92 comprises an upward tooth segment and a downward tooth segment connected thereto. As shown in FIG. 6A, the upward tooth segment of each of the driving teeth 92 is inclined in the direction opposite to the rotational direction of the lower cam 9, while the downward tooth segment of each of the driving teeth 92 is inclined downward in said direction opposite to the rotational direction of the lower cam 9. The inclination of the upward tooth segment is relatively gentle, and for example, can be designed according to the required height of the stroke, and is by no means limited in the present invention. By contrast, the inclination of the downward tooth segment is relatively steep, and for example, can be a vertical surface, so that the upper cam 8 can move towards the lower cam 9 with a relatively high speed. The driving teeth 92 rotates clockwise with a certain rotational speed, which ensures that the downward tooth segment of the driven teeth 82 would not touch the downward tooth segment of the driving teeth 92, thus further ensuring that the movement of the upper cam 8 towards the lower cam 9 is a free fall movement. That is, the upper cam 8 can move upstream relative to the lower cam 9 at a relatively slow speed, but move downward at a relatively fast speed. In the circumferential direction, a plurality of driven teeth 82 and a plurality of driving teeth 92 can be provided as required, and at the area where the downward tooth segment and the upper tooth segment of each driven tooth 82 are connected and at the area where the lower tooth segment and the upper tooth segment of each driving tooth 92 are connected, a transition fillet is provided for eliminating stress concentration and also buffering the movement between the upper cam 8 and the lower cam 9.

A damping assembly is arranged around the output main shaft 7. The lower end face of the lower cam 9 extends axially over the lower end face of the lower cam seat 10 to abut against the damping assembly. The lower end face of the damping assembly abuts against a limiting sleeve arranged on the output main shaft 7. It should note that the limiting sleeve is mainly used to limit the damping assembly axially. However, in order to optimize the structure, it is not necessary to provide an additional limiting sleeve on the output main shaft; in this case, an inner ring nut of a TC bearing fixedly arranged on the output main shaft 7 can serve as the limiting sleeve. That is to say, in the axial direction, the damping assembly is located between the lower cam 9 and the limiting sleeve. After one single impact is completed, the upper cam 8 will exert an impact force to the lower cam 9 at the moment when the upper tooth segment of the driven teeth 82 touches and meshes with the upper tooth segment of the driving teeth 92. By arranging the damping assembly, the impact force exerted on the lower cam 9 is transmitted to the damping assembly. That is, the damping assembly can absorb the energy received by the lower cam 9, and slow down the hard impact between the upper cam 8 and the lower cam 9, so as to protect the upper cam 8 and the lower cam 9 and prolong the service life of both.

In a preferred embodiment, the damping assembly includes two retaining rings 11 axially spaced from each other, and a disc spring 12 arranged between said two retaining rings 11. An upper retaining ring 11 is in contact with the lower end face of the lower cam 9, while a lower retaining ring 11 is in contact with the limiting sleeve. For example, the disc spring 12 is a Mubeu disc spring, in a form of pairing two single pieces together. The disc spring 12 has a pre-compressed amount initially set as N mm, which corresponds to a pre-tightening force of T kN. That is, when the impact force F received by the lower cam 9 is in the range of 0-T, the teeth of the upper cam 8 and the lower cam 9 will not be damaged.

Figure 4A:
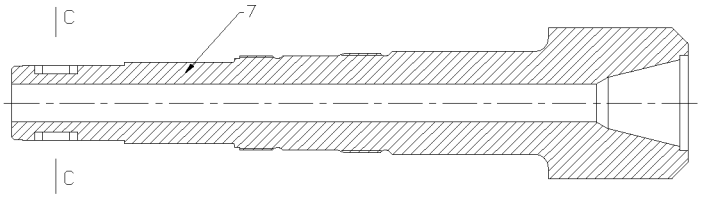
FIG. 4A shows a cross-sectional view of an output main shaft according to one embodiment in the drilling speed-enhancing device of FIG. 1.
Figure 4B:
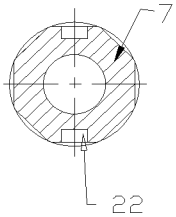
FIG. 4B shows a cross-sectional view of FIG. 4A along line C-C.

A third step surface 41 is arranged on the inner surface of the rotary main shaft 4, so that the size of the inner chamber of the rotary main shaft 4 is increased at the lower end thereof. During installation, the upper end of the output main shaft 7 extends axially upward into the inner chamber of the rotary main shaft 4, so that the upper end face thereof is opposite to the third step surface 41. A circumferential snap-fit connection is formed between the output main shaft 7 and the rotary main shaft 4. Specifically, as shown in FIGS. 4A and 4B, the portion of the output main shaft 7 extending into the rotary main shaft 4 is shaped as a polygonal column, e.g., an octagonal column. Correspondingly, the inner chamber of the lower end of the rotary main shaft 4 below the third step surface 41 is configured as having a polygonal cross section. Therefore, the above arrangement realizes a positive connection between the rotary main shaft 4 and the output main shaft 7, so that the rotary main shaft 4 can drive the output main shaft 7 in rotation. This arrangement can also ensure that the rotary main shaft 4 and the output main shaft 7 can move relative to each other in the axial direction, thereby ensuring that the rotary main shaft 4 can impact the output main shaft 7 to provide rock-breaking impact force. It should note that in order to avoid stress concentration, in the octagonal column where the inner wall of the rotary main shaft 4 is in engagement with the outer wall of the output main shaft 7, adjacent sides of the octagonal column are connected with each other with a rounded corner, thus ensuring smooth connection.

Figure 3C:
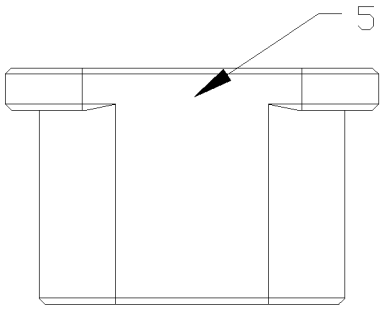
FIG. 3A shows a front view of a limiting key according to one embodiment in the drilling speed-enhancing device of FIG. 1.
FIG. 3B shows a bottom view of the limiting key according to one embodiment in the drilling speed-enhancing device of FIG. 1.
Figure 3D:
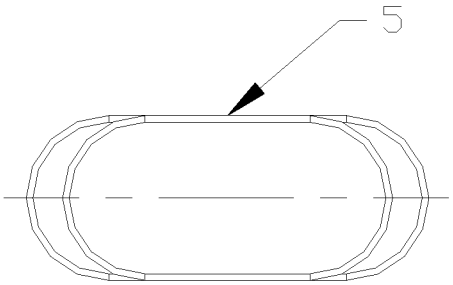

Of course, the axial position of the output main shaft 7 relative to the rotary main shaft 4 should be further restricted, in order to prevent the output main shaft 7 from dropping-off during tripping operations. Specifically, a limiting groove 22 extending axially is arranged on the outer wall of the output main shaft 7. For example, multiple pairs (e.g., one pair, two pairs, three pairs or four pairs) of limiting grooves 22 may be arranged in the circumferential direction, and two limiting grooves 22 of each pair are distributed relative to each other in order to ensure force balance. Correspondingly, a step hole 42 passing through the rotary main shaft 4 is provided on the rotary main shaft 4, and has a diameter of the radially outer portion larger than that of the radially inner portion. The limiting key 5 is arranged in the step hole 42. Correspondingly, as shown in FIGS. 3A and 3B, the main body of the limiting key 5 is elongated and extends along the axial direction, so as to improve the shear strength. In the radial direction, the limiting key 5 is formed as a step. For example, a radially outer portion of the limiting key 5 is an A-type ordinary flat key, and a radially inner portion thereof is a step key formed by expanding said A-type ordinary flat key outward. Accordingly, the cross-sectional size of the radially outer portion is larger than that of the radially inner portion. Therefore, the limiting key 5 is arranged in the step hole 42, with the radially outer portion having a large cross-sectional size being clamped at the step hole while the radially inner portion extending radially inward into the limiting groove 22. A ferrule 3 is fixed on the outer wall of the rotary main shaft 4. The ferrule 3 can radially restrict the limiting key 5 to prevent it from falling out from the step hole 42. During the axial movement of the output main shaft 7 relative to the rotary main shaft 4, the limiting key 5 can move axially within the limiting groove 22 to a limited extent, so as to restrict the further relative movement of the output main shaft 7. For example, during tripping operations, the output main shaft 7 drives the lower cam 9 or the like to fall down relative to the rotary main shaft 4 or the like, so that a groove wall surface at the upper end of the limiting groove 22 is received on the limiting key 5. In this manner, the limiting key 5 can realize an anti-drop effect.

Figure 2A:
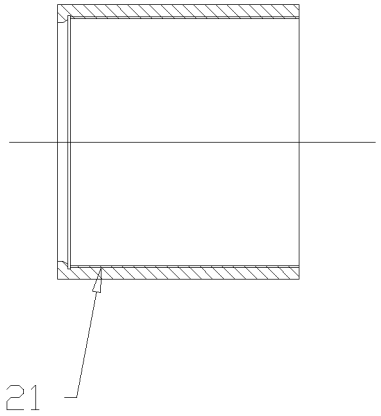
FIG. 2A shows a cross-sectional view of a ferrule according to one embodiment in the drilling speed-enhancing device of FIG. 1.
Figure 2B:
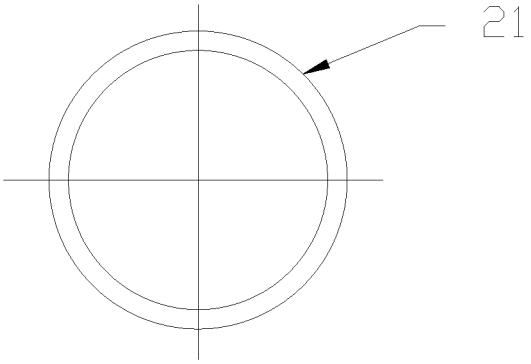
FIG. 2B shows a left view of the ferrule according to one embodiment in the drilling speed-enhancing device of FIG. 1.

As shown in FIGS. 2A and 2B, the inner surface of the ferrule 3 has two portions of different inner diameters, wherein the portion with a relatively large inner diameter is provided with thread to form a fixed connection with the rotary main shaft 4. A step surface connecting said two portions forms a snap-fit connection with the rotary main shaft 4. A downward inclined slope of 60 degrees is provided between the step surface connecting said two portions and the inner wall surface of the portion of the ferrule 3 with a relatively small inner diameter. In this manner, when the ferrule 3 is mounted, the screwing depth of the thread can be limited, and the ferrule 3 can be better matched with the rotary main shaft 4 via the step surface, thus preventing structural interference.

It should note that when the output main shaft 7 is seated on the limiting key 5 during tripping operations, the driven teeth 82 and the driving teeth 92 will be separated from each other by a certain distance in the axial direction, thus ensuring that the driven teeth 82 cannot be in contact with the driving teeth 92 in blank rotation. In this manner, the safety of the teeth can be improved. Moreover, after correct installation, the inner end face of the limiting key 5 has a certain distance in the radial direction from the bottom wall of the limiting groove 22 of the output main shaft 7, wherein the value of said distance should meet the requirement on the torsion angle of the output main shaft 7, thus preventing the limiting key 5 from being sheared during rotation of the output main shaft 7. This arrangement ensures the safety of the limiting key 5 in use, and increases its service life. Moreover, when the WOB is applied after the drilling tool touches the bottom of the well, the wall surface at the lower end of the limiting groove 22 will not contact the limiting key 5 during the upward movement of the output main shaft 7 relative to the rotary main shaft 4. In this manner, the limiting key 5 is prevented from being impacted, thus improving its safety in use.

A TC bearing assembly is provided between the outer cylinder and the output main shaft 7. An inner ring 18 of the TC bearing assembly is connected with the output main shaft 7 by an interference fit. A bearing shell 15 of the TC bearing assembly is located outside the inner ring 18 of the TC bearing assembly and engaged therewith, and fixedly arranged at the lower end of the outer cylinder. An inner-ring locking nut 13 of the TC bearing assembly is fixedly arranged around the output main shaft 7, and located at an upper end of the inner ring 18 of the TC bearing assembly. This arrangement ensures a smooth rotation of the output main shaft 7 relative to the outer cylinder. In a specific embodiment, the bearing shell 15 of the TC bearing assembly and the cylindrical body 14 are connected with each other through drill-pipe joint threads arranged on inclined contact surfaces therebetween, so as to realize a fixed connection. An inner side of the inner-ring locking nut 13 of the TC bearing assembly is provided with a left-handed trapezoidal female thread, which is engaged with the left-handed trapezoidal male thread on the output main shaft 7, for tightening the inner ring 18 of the TC bearing assembly located downstream.

A positioning sleeve 19 is provided at the lower end of the inner ring 18 of the TC bearing assembly. For example, the positioning sleeve 19 may have a conical cross-section. After the positioning sleeve 19 is arranged around the output main shaft 7, the upper end of the positioning sleeve 19 is in contact with the inner ring 18 of the TC bearing assembly, while the lower end thereof is in contact with a fifth step surface 71 formed on the output main shaft 7. The positioning sleeve 19 is used to axially press the inner ring 18 of the TC bearing assembly.

In one embodiment, a first seal is provided between the outer cylinder and the rotary main shaft 4. The first seal can be a rotary seal ring 2, e.g., a RDI profile rotary seal ring by Hunger DFE GmbH. Additionally, a second seal is provided between the inner ring 18 of the TC bearing assembly and the bearing shell 15 of the TC bearing assembly. Also, the second seal may be in the form of a double-pass seal, and specifically a GDSA profile piston seal 16 by Hunger DFE GmbH and a RODA profile rotary seal 17 by Hunger DFE GmbH located therebelow. A sealed chamber is formed in an area defined by a portion of the outer cylinder from the first seal and the second seal, the rotary main shaft 4, and the output main shaft 7. Lubricating oil is poured into the sealed chamber, in order to provide an oil-sealing environment for the upper cam 8, the lower cam 9, the disc spring 12 or the like arranged therein, thus greatly prolonging their service life. A third sealing ring 6 is further provided between the rotary main shaft 4 and the output main shaft 7 to achieve sealing therebetween. The third sealing ring 6 is located below the limiting groove 22.

The specific working process of the drilling speed-enhancing device 100 according to FIGS. 1 to 7B is described in detail as follows.

First, the above-mentioned drilling speed-enhancing device 100 is arranged on a dual-drive drilling tool, wherein the outer cylinder 1 is connected with the housing of the downhole power motor of the dual-drive drilling tool, while the rotary main shaft 4 is connected with the rotating shaft of the downhole power motor of the dual-drive drilling tool. A drilling bit is arranged at the lower end of the output main shaft 7.

Then, the dual-drive drilling tool provided with the drilling speed-enhancing device 100 is lowered into the well to be drilled. During this process, the output main shaft 7, the lower cam 9, the damping assembly, the inner-ring locking nut 13 and the inner ring 18 of the TC bearing assembly, the positioning sleeve 19 and the drilling bit move downward together relative to the outer cylinder, and further downward movement can be prevented since the output main shaft 7 is seated on the upper end face of the limiting key 5. At this time, the teeth of the upper cam 8 are not in contact with the teeth of the lower cam 9, so as to ensure that the teeth will not collide with each other.

When the drilling bit of the drilling tool touches the bottom of the well, the drilling tool is further lowered to apply the WOB, so that the output main shaft 7 drives the lower cam 9 or the like to move axially upward relative to the outer cylinder and the rotary main shaft 4, until the lower cam 9 and the upper cam 8 are in cooperation. At this time, since the upward tooth segments of the driven teeth 82 of the upper cam and those of the driving teeth 92 of the lower cam are engaged with each other, there is a certain axial distance, which less than C, between the upper end face 20 of the output main shaft 7 and the third step surface 41 of the rotary main shaft 4.

Then, drilling operation may start. The rotary main shaft 4 is rotated by the rotating shaft of the downhole power motor, so as to drive the output main shaft 7 in rotation to supply rotational power to the drilling bit arranged at the lower end of the output main shaft 7. At the same time, the rotating output main shaft 7 drives the lower cam 9 to rotate together, which axially pushes up the upper cam 8 to lift the outer cylinder and the rotary main shaft 4. After reaching the highest point, the outer cylinder and the rotary main shaft 4 will, under the action of the WOB, impact downward on the upper end face of the output main shaft 7. The axial reciprocating impact acts on the output main shaft 7, and is finally transmitted to the drilling bit. As a result, when the drilling bit rotates, reciprocating impact will be generated to improve rock-breaking efficiency, which provides new technical means for efficient drilling in hard and complex formations for ultra-deep oil wells, geothermal wells, and dry-hot rock wells.

In the present invention, it should be emphasized that the outer wall of the rotary main shaft 4 consists of three sections for axially positioning the ferrule 3, while the inner wall of the rotary main shaft 4 consists of two sections, that is, includes the third step surface 42 so that the inner diameter of the upper section is smaller than that of the lower section. The inner chamber of the upper section is mainly used for conveying drilling fluid, while that of the lower section is mainly used for arranging the output main shaft 7 therein. The rotary main shaft with the above arrangement has an optimized structure, and ensures good transmission of power.

The outer wall of the output main shaft 7 consists of multiple sections from top to bottom, for example, eight sections. On the outer wall of the output main shaft 7, the outer diameter of the output shaft 7 can be increased gradually from top to bottom through arranging step surfaces, which can engage and connect with different members. Specifically, from top to bottom, the diameter of the first segment is relatively small to ensure that the output main shaft 7 is guided to be inserted into the rotary main shaft 4. The second section can guarantee to form a circumferential snap-fit connection with the rotary main shaft 4 for ensuring power transmission. The third section is used to arrange the upper cam 8, the lower cam 9 and the lower cam seat 10 thereon, for achieving coaxial orientation. The fourth section is used to mount the lower cam seat 10 with the left-handed trapezoidal thread. The fifth section is used to arrange the damping assembly. The sixth section is used to mount the inner-ring locking nut 13 of the TC bearing assembly with the left-handed trapezoidal male thread. The seventh section is used to arrange the inner ring 18 of the TC bearing assembly and the locating sleeve 19. The eighth section is provided in its inner chamber with thread for connection with the drilling bit. For example, transition slopes may be provided between the above adjacent sections.

Although the present invention has been described with reference to the preferred embodiments, various modifications may be made and equivalents may be substituted for components thereof without departing from the scope of the present invention. In particular, under the condition that there is no structural conflict, each technical feature mentioned in each embodiment can be combined in any manner. The present invention is not limited to the specific embodiments disclosed herein, but includes all technical solutions falling within the scope of the claims.

The invention claimed is:

1. A drilling speed-enhancing device, comprising:

an outer cylinder;

a rotary main shaft arranged in an inner chamber of the outer cylinder and configured to rotate around its own axis;

an output main shaft arranged below the rotary main shaft and configured to be driven by the rotary main shaft to rotate around its own axis, a lower end of the output main shaft extending out of the inner chamber of the outer cylinder;

a percussion generator arranged between the output main shaft and the outer cylinder, and configured to drive the outer cylinder and the rotary main shaft to move upward relative to the output main shaft, so that under action of WOB, the rotary main shaft and the outer cylinder move downward to generate impact on the output main shaft, the percussion generator comprising:

an upper cam arranged around an outer wall of the output main shaft in a clearance fit, and fixed relative to the outer cylinder in an axial direction and a circumferential direction, a lower end of the upper cam being provided with driven teeth; and a lower cam arranged around the outer wall of the output main shaft, and provided at an upper end thereof with driving teeth, which form with the driven teeth a conjugate set of cam teeth, wherein during rotation of the output main shaft the lower cam is driven to rotate, and the driving teeth act on the driven teeth to enable that the upper cam moves reciprocally in the axial direction and acts on the outer cylinder, and wherein a lower cam seat is fixedly arranged around the output main shaft, and an outer wall of the lower cam seat is provided with engaging teeth protruding therefrom, each clamping tooth extending radially outward in a respective one of engaging slots formed on a wall of the lower cam, an upper end face of the lower cam seat abutting against a first step surface formed in an inner chamber of the lower cam.

2. The drilling speed-enhancing device according to claim 1, wherein a lower end face of the lower cam extends axially over a lower end face of the lower cam seat to abut against a damping assembly arranged around the output main shaft, a lower end face of the damping assembly being in contact with a limiting sleeve arranged on the output main shaft.

3. The drilling speed-enhancing device according to claim 2, wherein the damping assembly comprises two retaining rings axially spaced from each other, and a disc spring arranged between said two retaining rings, an upper one of the retaining rings abutting against the lower end face of the lower cam while a lower one of the retaining rings abutting against the limiting sleeve.

4. The drilling speed-enhancing device according to claim 3, wherein a bearing assembly is provided between the outer cylinder and the output main shaft, and wherein an inner ring of the bearing assembly is connected with the output main shaft in an interference fit;

a bearing shell of the bearing assembly is fixedly arranged on the lower end of the outer cylinder; and an inner-ring locking nut of the bearing assembly is fixedly arranged around the output main shaft, and located above the inner ring of the bearing assembly.

5. The drilling speed-enhancing device according to claim 2, wherein the outer cylinder is of a combined structure, and comprises an upper joint and a cylindrical body connected to a lower end of the upper joint via thread, an outer wall of the upper cam being sandwiched between a lower end face of the upper joint and a second step surface formed on the cylindrical body, and an upper end face of the upper cam being connected with the lower end face of the upper joint via teeth.

6. The drilling speed-enhancing device according to claim 2, wherein an upper end of the output main shaft extends into an inner chamber of the rotary main shaft and forms a circumferential snap-fit connection therebetween; and an upper end face of the output main shaft is opposite to a third step surface formed on an inner side of the rotary main shaft, wherein a limiting groove is arranged on an outer wall of the output main shaft, and a limiting key is fixed on the rotary main shaft to extend radially into the limiting groove.

7. The drilling speed-enhancing device according to claim 2, wherein an upper end of the output main shaft extends into an inner chamber of the rotary main shaft and forms a circumferential snap-fit connection therebetween; and an upper end face of the output main shaft is opposite to a third step surface formed on an inner side of the rotary main shaft, wherein a limiting groove is arranged on an outer wall of the output main shaft, and a limiting key is fixed on the rotary main shaft to extend radially into the limiting groove.

8. The drilling speed-enhancing device according to claim 2, wherein an upper end of the output main shaft extends into an inner chamber of the rotary main shaft and forms a circumferential snap-fit connection therebetween; and an upper end face of the output main shaft is opposite to a third step surface formed on an inner side of the rotary main shaft, wherein a limiting groove is arranged on an outer wall of the output main shaft, and a limiting key is fixed on the rotary main shaft to extend radially into the limiting groove.

9. The drilling speed-enhancing device according to claim 2, wherein a bearing assembly is provided between the outer cylinder and the output main shaft, and wherein an inner ring of the bearing assembly is connected with the output main shaft in an interference fit;

a bearing shell of the bearing assembly is fixedly arranged on the lower end of the outer cylinder; and an inner-ring locking nut of the bearing assembly is fixedly arranged around the output main shaft, and located above the inner ring of the bearing assembly.

10. The drilling speed-enhancing device according to claim 1, wherein the outer cylinder is of a combined structure, and comprises an upper joint and a cylindrical body connected to a lower end of the upper joint via thread, an outer wall of the upper cam being sandwiched between a lower end face of the upper joint and a second step surface formed on the cylindrical body, and an upper end face of the upper cam being connected with the lower end face of the upper joint via teeth.

11. The drilling speed-enhancing device according to claim 10, wherein a bearing assembly is provided between the outer cylinder and the output main shaft, and wherein an inner ring of the bearing assembly is connected with the output main shaft in an interference fit;

a bearing shell of the bearing assembly is fixedly arranged on the lower end of the outer cylinder; and an inner-ring locking nut of the bearing assembly is fixedly arranged around the output main shaft, and located above the inner ring of the bearing assembly.

12. The drilling speed-enhancing device according to claim 1, wherein the outer cylinder is of a combined structure, and comprises an upper joint and a cylindrical body connected to a lower end of the upper joint via thread, an outer wall of the upper cam being sandwiched between a lower end face of the upper joint and a second step surface formed on the cylindrical body, and an upper end face of the upper cam being connected with the lower end face of the upper joint via teeth.

13. The drilling speed-enhancing device according to claim 1, wherein an upper end of the output main shaft extends into an inner chamber of the rotary main shaft and forms a circumferential snap-fit connection therebetween; and an upper end face of the output main shaft is opposite to a third step surface formed on an inner side of the rotary main shaft, wherein a limiting groove is arranged on an outer wall of the output main shaft, and a limiting key is fixed on the rotary main shaft to extend radially into the limiting groove.

14. The drilling speed-enhancing device according to claim 13, wherein a wall of the rotary main shaft is provided with a step hole passing therethrough, the limiting key radially extending in the step hole to be clamped therewith; and a ferrule radially abutting against the limiting key is fixed on the outer wall of the rotary main shaft.

15. The drilling speed-enhancing device according to claim 1, wherein a bearing assembly is provided between the outer cylinder and the output main shaft, and wherein an inner ring of the bearing assembly is connected with the output main shaft in an interference fit;

a bearing shell of the bearing assembly is fixedly arranged on the lower end of the outer cylinder; and an inner-ring locking nut of the bearing assembly is fixedly arranged around the output main shaft, and located above the inner ring of the bearing assembly.

16. The drilling speed-enhancing device according to claim 15, wherein a first seal is provided between the outer cylinder and the rotary main shaft, and a second seal is provided between the inner ring and the bearing shell of the bearing assembly; and lubricating oil is filled in a spaced defined by the first seal, the second seal, the outer cylinder, the rotary main shaft and the output main shaft.

* * * * *